US005564355A

United States Patent [19]

Watson

[11] Patent Number: 5,564,355

[45] Date of Patent: Oct. 15, 1996

[54] ROTATABLE PRESSER FOOT FOR USE IN A SEWING MACHINE

[75] Inventor: Donald E. Watson, West Carrollton, Ohio

[73] Assignee: MIM Industries, Inc., Miamisburg, Ohio

[21] Appl. No.: 828,367

[22] Filed: Jan. 30, 1992

[51] Int. Cl.[6] ..... D05B 29/00

[52] U.S. Cl. ..... 112/235; 112/475.01

[58] Field of Search ..... 112/235, 236, 112/240, 475.01

[56] References Cited

U.S. PATENT DOCUMENTS

| | | | |
|---|---|---|---|
| 22,269 | of/1858 | Tyler . | |
| 312,923 | 2/1885 | Stewart | 112/236 X |
| 875,640 | 12/1907 | Woodward | 112/240 |
| 913,847 | 3/1909 | Prall | 112/236 |
| 1,202,283 | 10/1916 | Gray . | |
| 1,387,034 | 8/1921 | Barron et al. . | |
| 1,823,505 | 9/1931 | O'Neill . | |
| 3,224,393 | 12/1965 | Adams et al. | 112/2 |
| 3,875,878 | 4/1975 | Kaminski | 112/116 |
| 4,003,322 | 1/1977 | Yanikoski | 112/121.12 |
| 4,186,676 | 2/1980 | Villa et al. | 112/235 X |
| 4,280,422 | 7/1981 | Jung | 112/235 X |
| 4,325,313 | 4/1982 | Kawai et al. | 112/103 |
| 4,373,458 | 2/1983 | Dorosz et al. | 112/121.12 |
| 4,417,533 | 11/1983 | Oshima et al. | 112/235 |
| 4,467,737 | 8/1984 | Breck, Jr. . | |
| 4,498,407 | 2/1985 | Landwehr et al. | 112/308 |
| 4,664,045 | 5/1987 | Landwehr et al. | 112/153 |
| 4,854,251 | 8/1989 | Hiramatsu et al. | 112/121.12 |
| 4,926,769 | 5/1990 | Upmeier | 112/121.12 |
| 4,981,094 | 1/1991 | Stapel et al. | 112/235 |

FOREIGN PATENT DOCUMENTS

| | | | |
|---|---|---|---|
| 2125766 | 12/1972 | Germany | 112/236 |

OTHER PUBLICATIONS

"The Technologies of MIM Industries, Inc" Sales brochure, Jan. 1, 1990.

*Primary Examiner*—Paul C. Lewis

*Attorney, Agent, or Firm*—Jacox, Meckstroth & Jenkins

[57] ABSTRACT

A rotatable presser foot for use in a sewing machine having a sewing station. The rotatable presser foot comprises a foot member and a coupler for detachably and adjustably coupling the foot member to a needle bar in the sewing machine so that the foot member can be rotatably adjusted about a center axis of the needle bar. The coupler comprises a bracket which is adjustably fastened to the needle bar and a foot support on which the foot member can be adjustably secured. The coupler also comprises a resilient coupling located between the foot support and bracket so as to permit the foot member to be resiliently biased towards a sewing surface at the sewing station. The rotatable presser foot can be rotated to any predetermined location about the axis of the needle bar, thereby facilitating sewing workpieces of different shapes and configurations.

13 Claims, 4 Drawing Sheets

ROTATABLE PRESSER FOOT FOR USE IN A SEWING MACHINE

BACKGROUND OF THE INVENTION

1. Field of the Invention

This invention relates to sewing machines, and more particularly, it relates to a rotatable presser foot for detachably coupling to a needle bar in a sewing machine so that the foot member can be rotatably adjusted about a center axis of the needle bar.

2. Description of Related Art

In the sewing industry, a common repetitive function is to sew a label onto a workpiece of material. For example, this would be a common procedure when sewing a manufacturer's label onto a workpiece, such as a shirt or jacket. A typical sewing machine has a presser foot securely mounted in operative relationship with a reciprocating needle in the sewing machine. The sewing machine typically has a drive mechanism which was coupled to both the presser foot and the needle bar in the sewing machine. The drive mechanism would drive both the needle bar and the presser foot. A typical sewing machine of this type would be a Brother Model BAS-311 manufactured by Brother Industries of Japan.

The function of a presser foot is to force a workpiece into engagement with a feed dog. After the workpiece is stitched the feed dog urges the workpiece away from the sewing needle. Another function of the presser foot is to secure the workpiece firmly against a sewing surface so that the workpiece will not tent as the needle exits the workpiece. A typical sewing machine has a presser foot mechanism which is rigidly fixed to the needle bar and usually positioned to the left side of the needle bar when viewed from the position of an operator who is positioned in front of the sewing machine.

It is not uncommon that the configuration or shape of the workpiece to be sewn was such that it interfered with, for example, the heel of the presser foot mechanism when the workpiece is being loaded into a sewing position at the sewing station. The problem with the pressure foot arrangements of the past is that the pressure foot mechanisms were rigidly fixed to the sewing machine so that a heel of the presser foot is also in a fixed position on either side of the sewing needle. It is not uncommon that the position of the presser foot and particularly its heel will interfere with the sewing of the workpiece because, for example, of the shape of the workpiece or of a device secured to the workpiece. For example, when sewing a piece of webbing for a seat belt, having a large safety buckle on an end thereof, it may be necessary to position the buckle on the side of the sewing needle where the presser foot is located. The safety buckle may interfere with the heel of the presser foot thereby prohibiting the operator from sewing the seat belt webbing. This makes it difficult, if not impossible, to sew the workpiece. In addition, it inhibits the operator's efficiency and consequently results in lost production and labor time.

SUMMARY OF THE INVENTION

What is needed, therefore, is a presser foot which can be randomly or rotatably positioned around an axis of the needle bar of a sewing machine while at the same time enabling the pressure foot to maintain its primary function.

An object of this invention is to provide a rotatable presser foot for use in a sewing machine.

In one aspect, this invention comprises a fastener; said fastener comprising a foot support for supporting the presser foot in an operative relationship with a needle in the sewing machine.

In another aspect, this invention comprises a rotatable presser foot for use in a sewing machine comprising a needle bar having a sewing needle coupled thereto, said needle bar being capable of reciprocating towards and away from a sewing surface at a sewing station in the sewing machine, said rotatable presser foot comprising a foot member and a fastener for adjustably and rotatably fastening the foot member to the sewing machine so that said fastener and said foot member can be rotatably fastened about a center axis of said needle bar.

In yet another aspect, this invention comprises a method for sewing a workpiece at a sewing station in a sewing machine; said method comprising the steps of rotatably fastening a presser foot onto a sewing machine on operative relationship with a needle in the sewing machine a predetermined location which does not interfere with the sewing of the workpiece; and sewing said workpiece at the sewing station.

Another object of this invention is to provide a bracket for rotatably mounting a presser foot to a needle bar in a sewing machine.

Another object of this invention is to provide a presser foot which can be rotatably adjusted about the center axis of a needle bar in the sewing machine.

Still another object of this invention is to provide a rotatable presser foot which can be quickly and easily adjusted to permit various shaped workpieces to be 10 sewn by the sewing machine.

Yet another object of this invention is to provide a presser foot mechanism which can be adjustably secured at various positions along the longitudinal axis of the needle bar.

These objects, and others, may be more readily understood in connection with the following specification, claims, and drawing.

DESCRIPTION OF THE PREFERRED EMBODIMENT(S)

Figure 1:
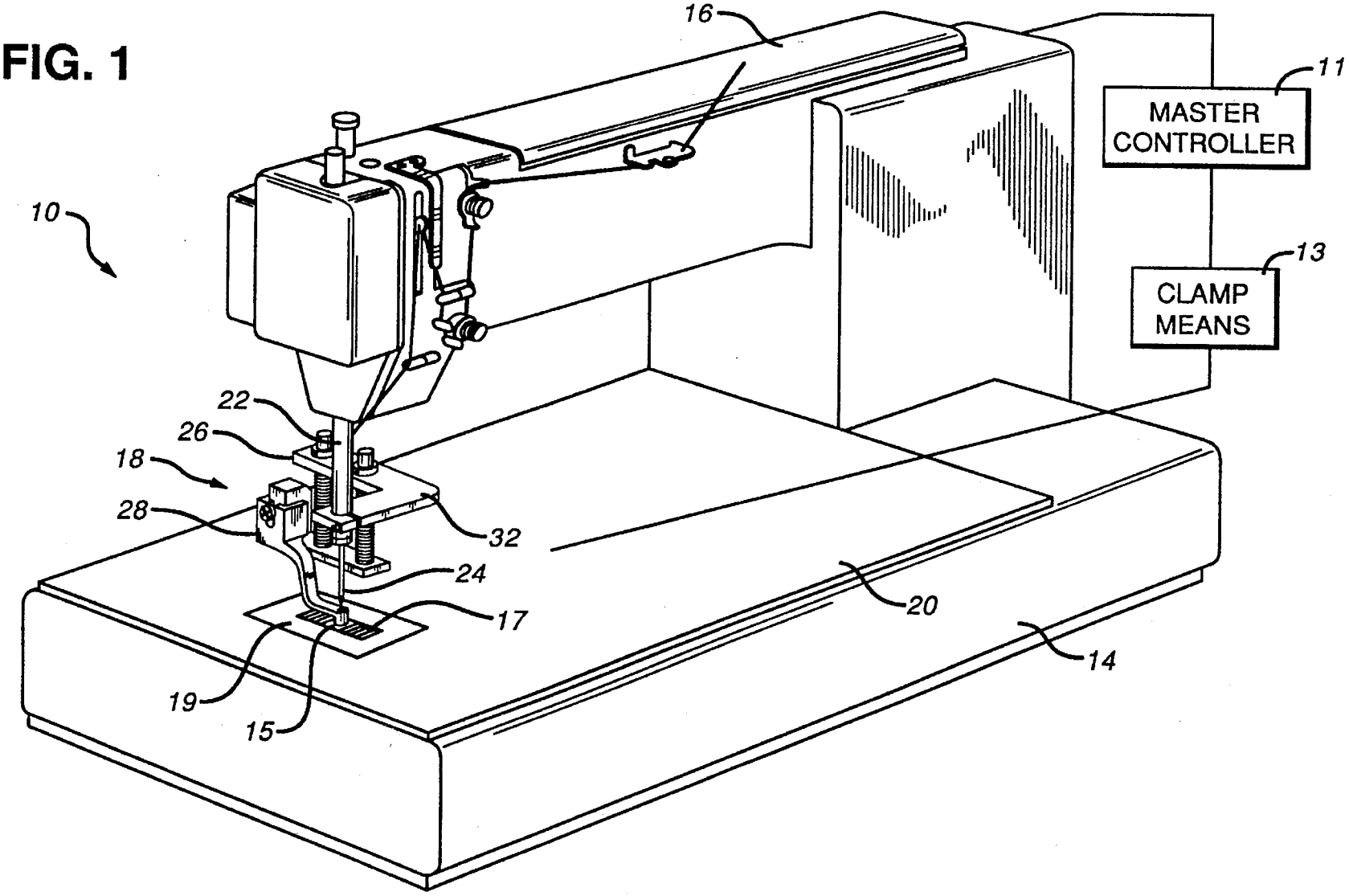
FIG. 1 is a perspective view of a sewing machine in which this invention may be used.

FIG. 1 shows a perspective view of a programmable sewing machine, hereinafter designated as sewing machine 10, in which a preferred embodiment of this invention may be used. The function of the sewing machine 10 is to sew a workpiece 12 (FIGS. 2 and 3), such as webbing. The workpiece 12 is sewn with a predetermined stitch pattern (not shown) in accordance with a computer program (not shown) which is controlled by a master controller 11 in the sewing machine 10. The sewing machine 10 comprises clamp means 13, which is coupled to the master controller 11, for clamping the workpiece 12 at a sewing station 18. In the embodiment being described, the clamp means 13 could be any suitable means for clamping the workpiece 12 at the sewing station 18. The sewing machine 10 may be any sewing machine, including any of the Brother BAS Series 300 programmable sewing machines, such as the BAS Model 311, which is manufactured by Brother Industries, Ltd. of Japan.

The sewing machine 10 comprises a base 14 having a horizontal arm 16 secured thereto. The sewing machine 10 also comprises the sewing station 18 at which the workpiece 12 can be sewn with the predetermined stitch pattern. The sewing station 18 includes a sewing surface 20. As best illustrated in FIG. 1, the horizontal arm 16 extends out over the sewing surface 20, and it has a needle bar 22 near the end thereof. The needle bar 22 supports a needle 24 for reciprocating motion in a fixed path that is generally vertical and perpendicular to the sewing surface 20. The needle 24 moves down through a hole 15 associated with a feed dog 17 in a throat plate 19 at the bottom of its stroke to transfer a loop of thread 21 (FIG. 3) to a loop taker (not shown) under the sewing surface 20 at the sewing station 18. The loop taker and needle bar 22 are both connected to a drive motor (not shown) which is controlled by the master controller 11 in the sewing machine 10.

The sewing machine 10 comprises a rotatable pressure foot 26 which is rotatably mounted to the needle bar 22. As best shown in FIGS. 2–5, the rotatable presser foot 26 comprises a generally L-shaped foot member 28 having a heel section **28*a* and an engaging section 28*b*. The rotatable presser foot 26 also comprises a fastener or coupling means 30 for detachably coupling the foot member 28 to the needle bar 22 in the sewing machine 10 so that the foot member 28 can be rotatably adjusted about a center axis 22*a* of the needle bar 22. The coupling means 30 comprises an L-shaped bracket 32 having an aperture 34 for receiving the needle bar 22. The L-shaped bracket 32 also comprises a slot 36 which is associated with the aperture 34 and which permits a machine screw 38 to be received in the threaded opening 40 in order to secure the L-shaped bracket 32 to the needle bar 22. The machine screw 38 can be loosened or tightened to permit the L-shaped bracket 32 to be repositioned on the needle bar 22 (for example, from the position shown in FIG. 1 to the position shown in FIG. 5**).

The fastener or coupling means 30 also comprises biasing means 42 for resiliently biasing the foot member 28 towards the sewing surface 20 of the sewing machine 10. The biasing means 42 comprises a foot support 44 having a first shaft 46 and a second shaft 48. The first shaft 46 has a first end **46*a*, and the second shaft 48 has a first end 48*a*. The first ends 46*a* and 48*a* are conventionally secured to a planar section 44*a* of the foot support 44. The planar section 44*a* has a support 62 upstanding therefrom. The first shaft 46 also comprises a second end 46*b*, and the second shaft 48 comprises a second end 48*b*. The L-shaped bracket 32 comprises a first receiving opening 50 and a second receiving opening 52. The function of the first and second receiving openings 50 and 52 is to slidably receive the second ends 46*b* and 48*b*, respectively. The biasing means 42 also comprises a first spring 54 and a second spring 56 which are received on the first and second shafts 46 and 48, respectively. The biasing means 42 further comprises a first sleeve 58 and a second sleeve 60 which are secured to the second ends 46*b* and 48*b* of the first and second shafts 46 and 48 after the first and second shafts 46 and 48 are guided through the first and second receiving openings 50 and 52, respectively. The first and second sleeves 58 and 60 have machine screws 58*a* and 60*a*, respectively, associated therewith for securing the first and second sleeves 58 and 60 to the second ends 46*b* and 48*b* of the first and second shafts 46 and 48. Although the embodiment being described herein shows a first and second shaft 46 and 48**, a single shaft, such as a single rectangular-shaped shaft (not shown), could be used.

Figure 2:
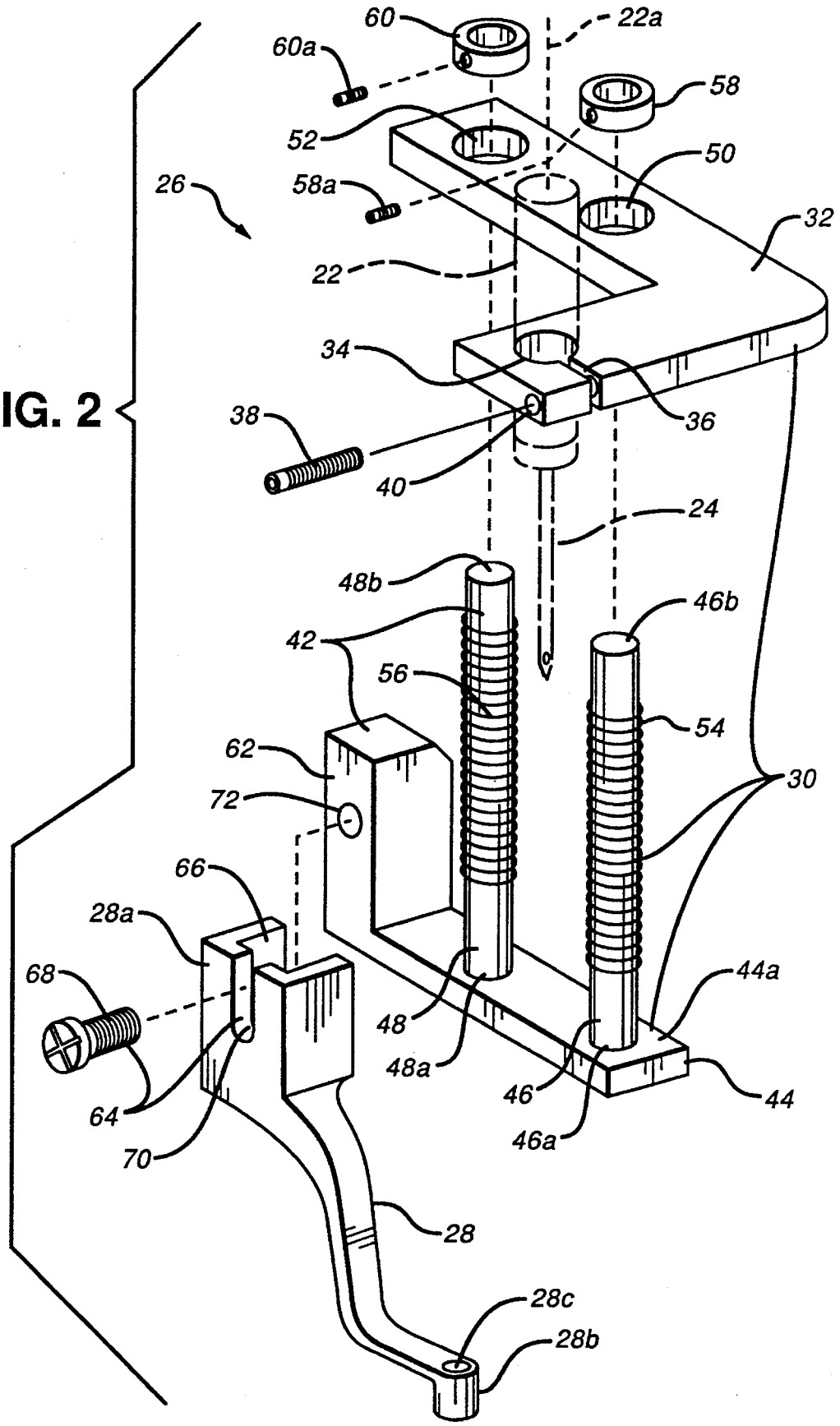
FIG. 2 is a perspective exploded view of a rotatable presser foot shown in FIG. 1.

As best shown in FIG. 2, the rotatable presser foot 26 further comprises adjustment means 64 for adjustably fastening the heel section **28*a* of the foot member 28 to the support 62. The heel section 28*a* comprises a generally rectangular opening 66 for slidably receiving the support 62. The adjustment means 64 also comprises a flat head screw 68 which cooperates with a U-shaped slot 70 in the heel section 28*a* of the foot member 28 to permit the foot member 28 to slidably adjust towards and away from the planar section 44*a* when the heel section 28*a* is slidably mounted on the support 62. The flat head screw 68 may be tightened and untightened in a threaded opening 72 in the support 62, thereby permitting the heel section 28*a* to be adjusted up and down (as viewed in FIG. 2) the support 62. Although not shown, the fastener or coupling means 30 could include any suitable means for detachably and adjustably coupling the foot member 28 to the needle bar 22**.

Figure 4:
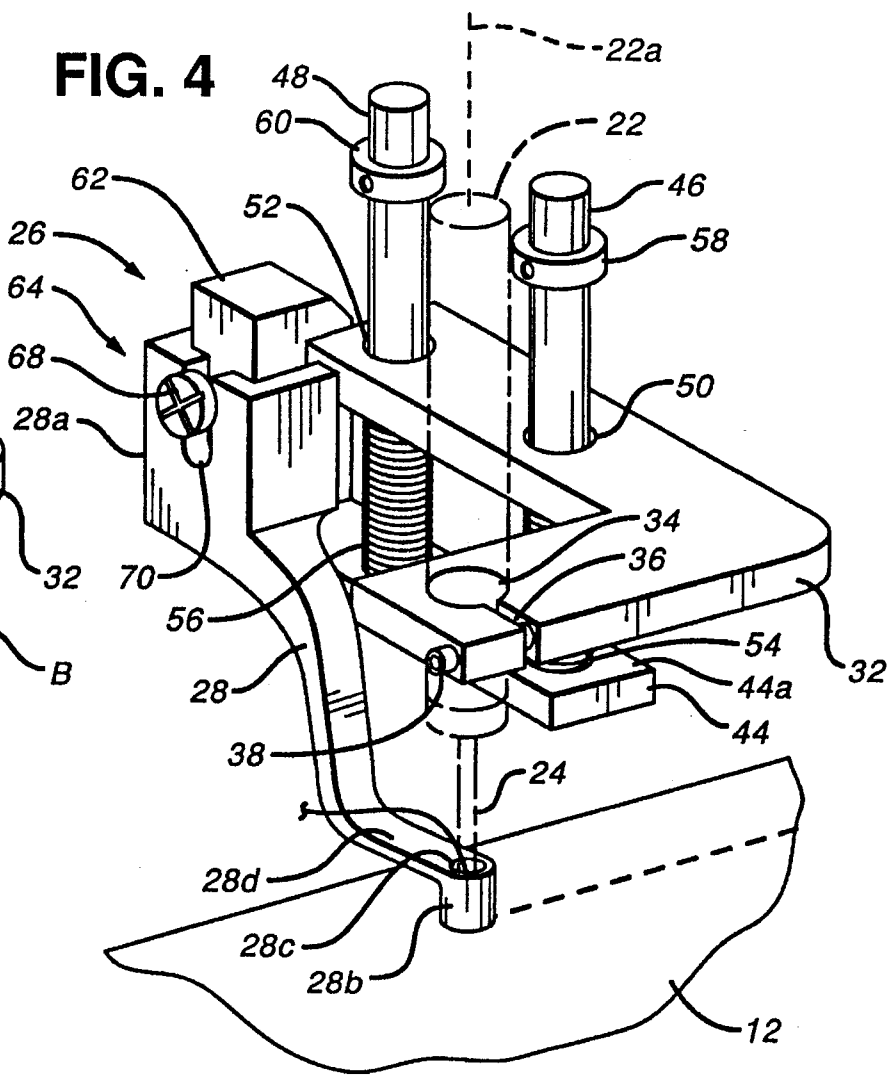
FIG. 4 is a perspective assembled view of the rotatable presser foot, similar to that shown in FIG. 3, showing the rotatable presser foot in an engaged position.
Figure 3:
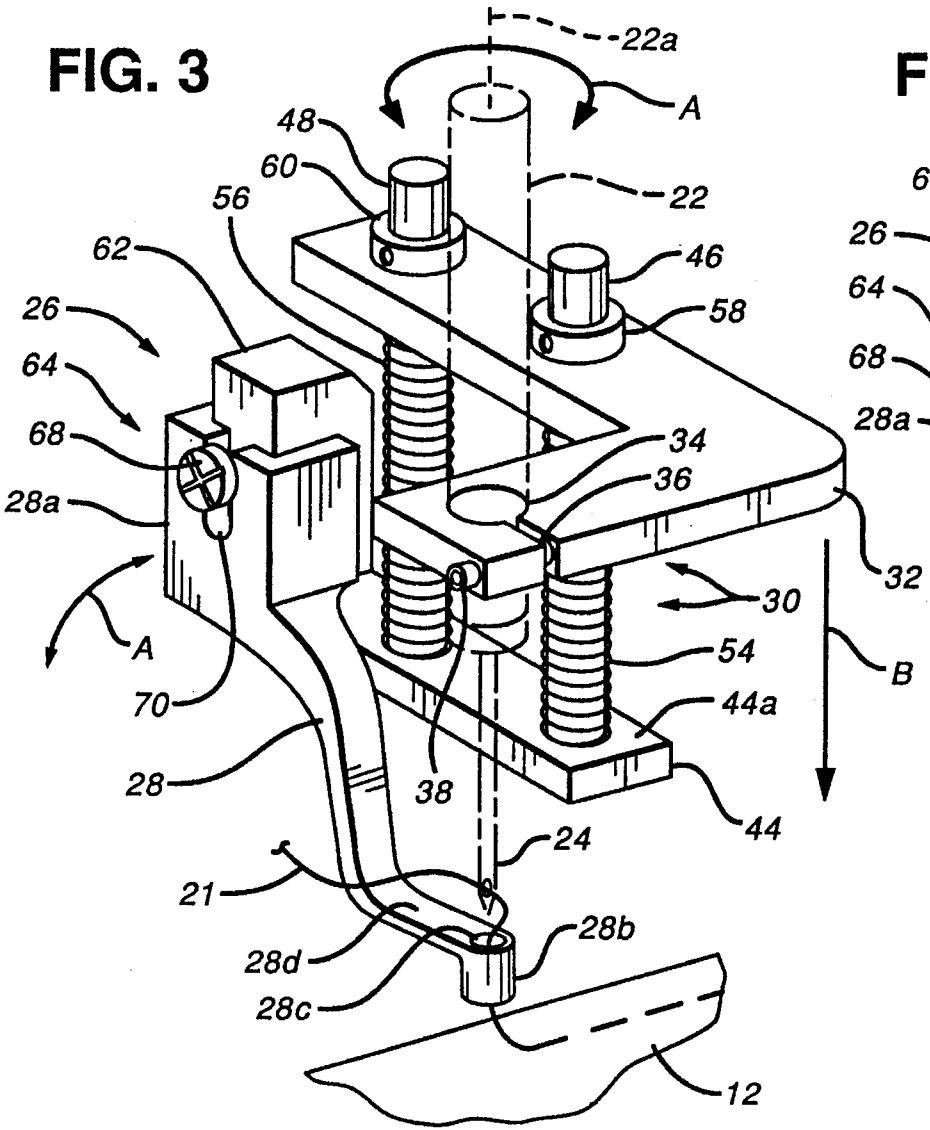
FIG. 3 is a perspective assembled view of the rotatable presser foot shown in FIG. 2, showing the presser foot in a non-engaged position.
Figure 5:
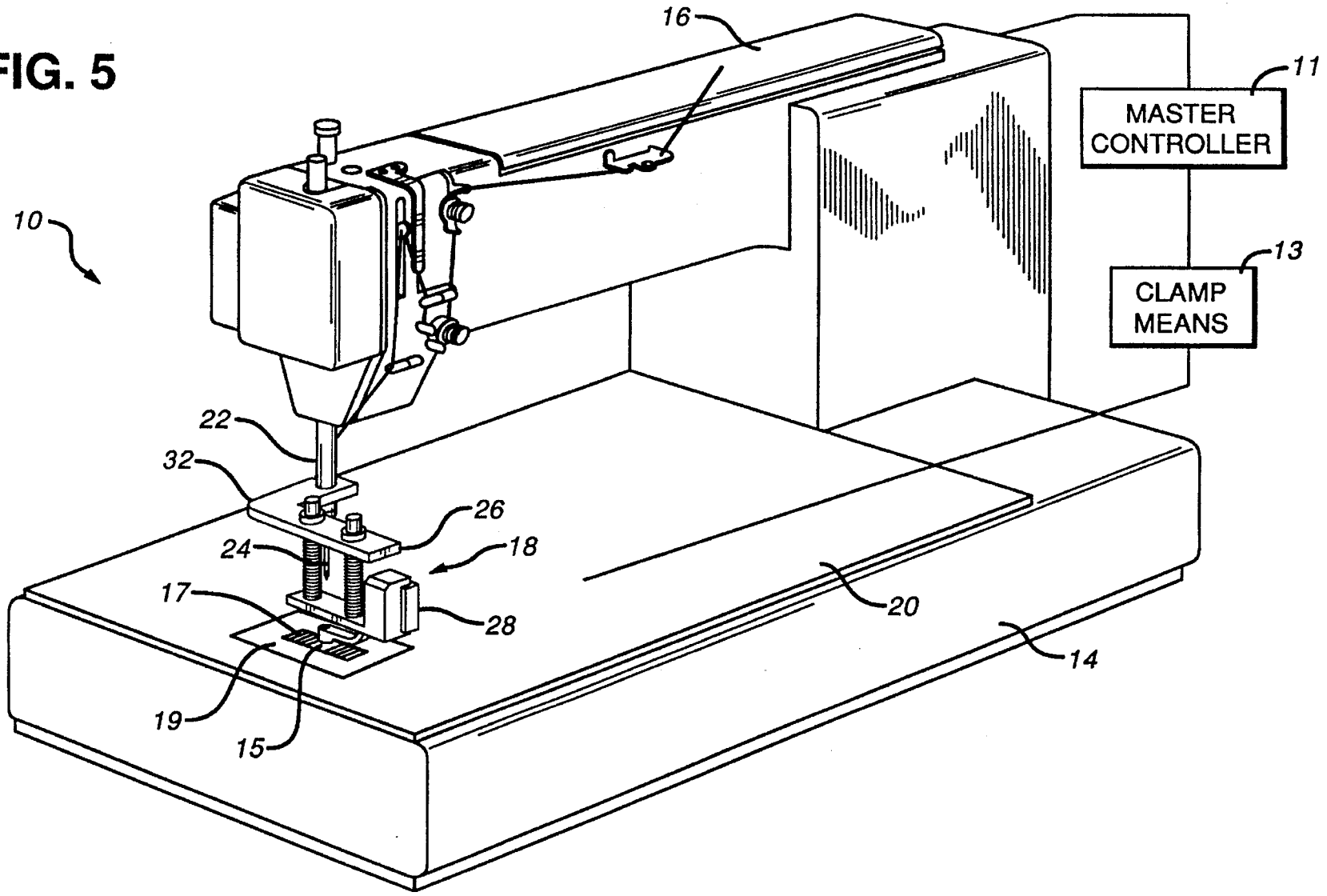
FIG. 5 is a perspective view of a sewing machine, similar to that shown in FIG. 1, except that the presser foot is in a different position.

Referring now to FIGS. 3–4, the rotatable presser foot 26 is shown in a fully assembled position. As shown in FIG. 3, the engaging section **28*b* of the foot member 28 comprises an eyelet 28*c* which is operatively related to the end of the sewing needle 24. As the rotatable presser foot 26 is adjustably rotated about the center axis 22*a*, the eyelet 28*c* remains in an operative relationship with the sewing needle 24. The function of the engaging section 28*b* and eyelet 28*c* is to prevent the workpiece 12 from flagging or tenting when the needle is reciprocated away from the workpiece 12. As shown in FIG. 3, the heel section 28*a* of the foot member 28 is slidably adjusted on the support 62 so that the distance between a top portion 28*d* of the engaging section 28*b* and the end of the sewing needle 24** is approximately ⅛ inch (3.2 mm) in its normal resting position, but this distance may be varied if desired.

The assembly and operation of the needle bar 26 10 will now be described. The first and second springs 54 and 56 are slidably received on the first and second shafts 46 and 48, respectively. The second ends **46*b* and 48*b* are then guided through the first and second receiving openings 50 and 52, respectively. The first and second shaft collars 58 and 60 are then guided onto the ends 46*b* and 48*b*, respectively, and the machine screws 58*a* and 60*a* are tightened. The foot support 44 is now slidably secured to the L-shaped bracket 32 so that the foot support 44 can be moved towards and away from the L-shaped bracket 32. The L-shaped bracket 32 is then positioned so that the needle bar 22 is received in the aperture 34. The machine screw 38 is then tightened so as to secure the coupling means 30 to the needle bar 22. By loosening and retightening the machine screw 38, the rotatable presser foot 26 may be rotated about the center axis 22*a* (in the direction of double arrow A of FIG. 3) of the needle bar 22** to any predetermined location.

As best illustrated in FIG. 3, the first and second springs 54 and 56 cause the engaging section **28*b* to be biased away from the L-shaped bracket 32 and towards the sewing surface 20. When the needle bar 22 moves or reciprocates in the direction of arrow B in FIG. 3, in order to sew a stitch on the workpiece 12, the engaging section 28*b* of the foot member 28 engages the workpiece 12 and secures a portion of the workpiece 12 against a feed dog 17. The needle bar 22 continues downward in the direction of arrow B in FIG. 3 so that the needle 24 passes through the eyelet 28***c* (FIG. 4) and the workpiece 12. The needle 24 moves down through the hole 15 at the bottom of its stroke to transfer a loop of thread to a loop taker (not shown) under the sewing surface 20 at the sewing station 18. The master controller 11 in the sewing machine 10 then causes the drive motor (not shown) to reciprocate the needle bar in the direction opposite that of arrow B in FIG. 3 in order to retract the needle 24 from the workpiece 12. It is to be noted that when the first and second springs 54 and 56 are fully compressed (FIG. 4), the needle bar 22 is at the bottom of its reciprocating stroke. The engaging section 28*b* of the foot member 28 remains engaged against the workpiece 12 as the sewing needle 24 is withdrawn from the workpiece 12. This facilitates preventing the workpiece form tenting or flagging as the needle 24 is withdrawn from the workpiece 12.

In order to facilitate sewing a second workpiece, it may be desirable to adjust the position of the rotatable presser foot 26. For example, it may be desirable to rotate the rotatable presser foot 26 from the first predetermined location shown in FIG. 1 to a second predetermined location shown in FIG. 5. In order to adjust the location of the rotatable presser foot 26, the machine screw 38 is loosened and the rotatable presser foot is then rotated about the axis 22*a* of the needle bar 22 towards a second predetermined location whereupon the machine screw 38 is tightened. The second workpiece can then be sewn at the sewing station 18.

The rotatable presser foot 26 can be adjusted to any point along the length of the needle bar 22, thereby permitting gross adjustments to be made between an engaging section 28*b* and the end of the needle 24. This permits the pressure or force with which the engaging section 28*b* of the foot member 28 forces the workpiece 12 against the feed dog 17 to be adjusted. Fine adjustments between the engaging section 28*b* and the end of the needle 24 can be made by untightening the flat head screw 68 and adjusting the position of the heel section 28*a* of the foot member 28 on the support 62. In the embodiment being described, these adjustments are most easily made when the needle bar 22 is in the non-engaged position shown in FIG. 3.

Advantageously, this invention provides a fastener or coupling means 30 for adjustably and rotatably fastening the foot member 28 about a center axis 22*a* of the needle bar 22 in order to facilitate sewing workpieces of various shapes and configurations.

Various changes or modifications in the invention described may occur to those skilled in the art without departing from the true spirit or scope of the invention. For example, the first and second shafts 46 and 48 could be replaced with a single shaft, such as a rectangular shaft, as mentioned earlier herein. In addition, although not shown the coupling means 30 could comprise any suitable means for coupling the foot member 28 to the needle bar 22. Likewise, the biasing means 42 has been shown as including the first and second springs 54 and 56; however, it could include any suitable structure which is capable of resiliently biasing the foot member 28 towards the sewing surface 20 at the sewing station 18. The L-shaped bracket 32 is secured to the needle bar 22 using an aperture 34, slot 36 and machine screw 38 arrangement, but it could be any suitable arrangement for fastening the L-shaped bracket 32 to the needle bar 22. Finally, the adjustment means 64 could also include any suitable means for adjustably coupling or fastening the foot member 28 to the support 62. The above description of the invention is intended to be illustrative and not limiting, and it is not intended that the invention be restricted thereto but that it be limited only by the true spirit and scope of the appended claims.

What is claimed is:

1. A rotatable pressure foot for use in a sewing machine having a sewing station, comprising:

a foot member; and coupling means for detachably and adjustably coupling said foot member to a needle bar in the sewing machine so that said foot member can be rotatably adjusted about a center axis of said needle bar;

said coupling means comprising biasing means for resiliently biasing said foot member towards a sewing surface of the sewing machine, said biasing means having at least one spring, said coupling means comprising an L-shaped bracket having an aperture therein for receiving said needle bar, said L-shaped bracket also having a slot associated with said aperture for adjustably and rotatably securing the bracket to said needle bar;

wherein said L-shaped bracket further comprises a first receiving opening, said biasing means further comprising:

a foot support;

a shaft collar associated with said first receiving opening;

at least one shaft having a first end and a second end, said first end being secured to said foot support, and said second end being slidably received in said first receiving opening;

a spring mounted on said at least one shaft between said foot support and said L-shaped bracket for resiliently biasing said foot support towards said sewing surface;

said shaft collar being secured to said second end after said second end is slidably received in said first receiving opening, thereby slidably securing said spring between said L-shaped bracket and said foot support.

2. The rotatable presser foot as recited in claim 1 wherein said rotatable presser foot further comprises adjustment means for adjustably mounting said foot member to said foot support, said adjustment means comprising a support located on said foot support, said presser foot further comprising an opening which slidably receives said support and which permits said foot member to be adjustably secured to said foot support.

3. The rotatable presser foot as recited in claim 1 wherein said L-shaped bracket further comprises a second receiving opening, said biasing means further comprising:

a second shaft collar associated with said second receiving opening;

a second shaft having a first end secured to said foot support and a second end slidably received in said second receiving opening;

a second spring mounted on said second shaft between said foot support and said L-shaped bracket;

said second shaft collar being secured to said second end of said second shaft after said second end is slidably received in said second receiving opening, thereby slidably securing said second spring between said L-shaped bracket and said foot support.

4. A sewing machine having a sewing station therein, said sewing machine comprising:

a master controller for controlling the operation of the machine;

a base having a sewing surface located at the sewing station;

a horizontal arm coupled to said base and having an end extending over said sewing surface;

a needle bar located at the end of said horizontal arm in operative relationship with said sewing station;

a rotatable presser foot comprising:

a foot member;

coupling means for detachably coupling said foot member to a needle bar in the sewing machine so that said foot member can be rotatably adjusted about a center axis of said needle bar;

said coupling means comprising biasing means having at least one spring for resiliently biasing said foot member towards a sewing surface of the sewing machine;

said coupling means comprising an L-shaped bracket having an aperture therein for receiving said needle bar, said L-shaped bracket also having a slot associated with said aperture for permitting said L-shaped bracket to be adjustably and rotatably secured to said needle bar;

wherein said L-shaped bracket comprises a first receiving opening, said biasing means further comprising:

a foot support;

a shaft collar associated with said first receiving opening;

at least one shaft having a first end and a second end, said first end being secured to said foot support, and said second end being slidably received in said first receiving opening;

a spring mounted on said at least one shaft between said foot support and said L-shaped bracket for resiliently biasing said foot support towards said sewing surface;

said shaft collar being secured to said second end after said second end is slidably received in said first receiving opening, thereby slidably securing said spring between said L-shaped bracket and said foot support.

5. The rotatable presser foot as recited in claim 4 wherein said rotatable presser foot further comprises adjustment means for adjustably mounting said foot member to said foot support, said adjustment means comprising a support located on said foot support, said presser foot further comprising an opening which slidably receives said support and which permits said foot member to be adjustably secured to said foot support.

6. The rotatable presser foot as recited in claim 5 wherein said L-shaped bracket further comprises a second receiving opening, said biasing means further comprising:

a second shaft collar associated with said second receiving opening;

a second shaft having a first end secured to said foot support and a second end slidably received in said second receiving opening;

a second spring mounted on said second shaft between said foot support and said L-shaped bracket;

said second shaft collar being secured to said second end of said second shaft after said second end is slidably received in said second receiving opening, thereby slidably securing said second spring between said L-shaped bracket and said foot support.

7. A rotatable pressure foot for use in a sewing machine comprising a needle bar having a sewing needle coupled thereto, said needle bar being capable of reciprocating towards and away from a sewing surface at a sewing station in the sewing machine, said rotatable pressure foot comprising:

a foot member; and a fastener for adjustably and rotatably fastening the foot member about a center axis of said needle bar;

said fastener further comprising an L-shaped member having an aperture therein for receiving said needle bar;

wherein said L-shaped member further comprises a slot associated with said aperture for permitting the size of said aperture to be adjusted so that said L-shaped bracket can be adjustably secured to said needle bar;

wherein said rotatably presser foot further comprises:

a resilient coupling for resiliently coupling said foot member to said fastener, said resilient coupling enabling said presser foot to be biased towards said sewing surface to resiliently bias a workpiece in a sewing position at the sewing station so that said sewing needle can sew said workpiece;

said resilient coupling further comprising a bracket having at least one shaft thereon and a compression spring mounted on said at least one shaft, said resilient coupling comprising at least one shaft collar for receiving said at least one shaft;

said foot member comprising an eyelet which is operatively related to the sewing needle, said foot member being adjustably secured about a center axis of said bracket so that said eyelet remains in an operative relationship with the sewing needle;

wherein said resilient coupling further comprises a bracket having at least one shaft thereon, said L-shaped member comprises a receiving opening for receiving said at least one shaft, a compression spring mounted on said at least one shaft, and a shaft collar for securing to an end of said at least one shaft to slidably secure said L-shaped member to said bracket;

said foot member comprising an eyelet which is operatively related to the sewing needle when said rotatable presser foot is coupled to the needle bar of the sewing machine.

8. A rotatable pressure foot for use in a sewing machine comprising a needle bar having a sewing needle coupled thereto, said needle bar being capable of reciprocating towards and away from a sewing surface at a sewing station in the sewing machine, said rotatable pressure foot comprising:

a foot member;

a fastener for adjustably and rotatably fastening the foot member about a center axis of said needle bar;

said fastener further comprising an L-shaped member having an aperture therein for receiving said needle bar;

wherein said L-shaped member further comprises a slot associated with said aperture for permitting the size of said aperture to be adjusted so that said L-shaped bracket can be adjustably secured to said needle bar;

wherein said rotatably presser foot further comprises:

a resilient coupling for resiliently coupling said foot member to said fastener, said resilient coupling enabling said presser foot to be biased towards said sewing surface to resiliently bias a workpiece in a sewing position at the sewing station so that said sewing needle can sew said workpiece;

said resilient coupling further comprising a bracket having at least one shaft thereon and a compression spring mounted on said at least one shaft, said resilient coupling comprising at least one shaft collar for receiving said at least one shaft;

said foot member comprising an eyelet which is operatively related to the sewing needle, said foot member being adjustably secured about a center axis of said bracket so that said eyelet remains in an operative relationship with the sewing needle.

9. A bracket for rotatably mounting a presser foot to a needle bar in a sewing machine, said bracket comprising:

a fastener for connecting the presser foot to the needle bar;

said fastener comprising a foot support for rotatably supporting the presser foot in an operative relationship with a needle in the sewing machine; and said fastener further comprising an L-shaped member having an aperture therein for receiving said needle bar;

a resilient coupling for resiliently coupling said foot member to said fastener, said resilient coupling enabling said rotatable presser foot to be biased towards said sewing surface in order to resiliently bias a workpiece in a sewing position at the sewing station so that said sewing needle can sew said workpiece;

said resilient coupling further comprising:

at least one shaft having an end secured to said foot support, said L-shaped member comprising a receiving opening for receiving said at least one shaft;

a compression spring mounted on said at least one shaft; and a shaft collar for mounting on a second end of said at least one shaft after said second end is received in said receiving opening, thereby slidably securing said compression spring between said L-shaped member and said bracket.

10. The bracket as recited in claim 9 wherein said foot member comprises an eyelet which becomes operatively related to the sewing needle when said L-shaped member is mounted on said needle bar.

11. A bracket for rotatably mounting a presser foot to a needle bar in a sewing machine, said bracket comprising:

a fastener for connecting the presser foot to the needle bar such that said presser foot can be rotated about the needle bar so that it will not interfere with a workpiece which is being positioned at a sewing station in the sewing machine;

said fastener comprising a foot support for rotatably supporting the presser foot in an operative relationship with a needle in the sewing machine;

a resilient coupling for resiliently coupling said foot support to said fastener, said resilient coupling biasing said presser foot towards a sewing surface in the sewing machine and being capable of urging a workpiece against said sewing surface to permit said sewing needle to sew said workpiece;

at least one shaft mounted on said foot support, said L-shaped member comprising a receiving opening for receiving said at lest one shaft;

a compression spring mounted on said at least one shaft; and a shaft collar for mounting on a second end of said at least one shaft after said second end is received in said receiving opening, thereby slidably securing said compression spring between said L-shaped member and said foot support.

12. A method for sewing a workpiece at a sewing station in a sewing machine; said method comprising the steps of:

(a) rotatably fastening a pressure foot onto a sewing machine about the center axis of a needle bar at a predetermined location which does not interfere with the sewing of the workpiece;

(b) sewing said workpiece at the sewing station;

(c) rotatably adjusting the presser foot about the center axis of a needle bar of the sewing machine to a second predetermined location in order to facilitate sewing a second workpiece; and (d) rotatably fastening said pressure foot to the needle bar at said second predetermined location after said rotatable adjustment in step (c).

13. The method as recited in claim 12 wherein said method further comprises the steps of:

adjusting said presser foot to a third predetermined location; and fastening said presser foot at said third predetermined location.

* * * * *